US007537220B2

(12) United States Patent
Findling

(10) Patent No.: US 7,537,220 B2
(45) Date of Patent: May 26, 2009

(54) SKATEBOARD SYSTEM

(75) Inventor: Keith Findling, Salt Lake City, UT (US)

(73) Assignee: FM Products, Inc., Salt Lake City, UT (US)

( * ) Notice: Subject to any disclaimer, the term of this patent is extended or adjusted under 35 U.S.C. 154(b) by 279 days.

(21) Appl. No.: 11/530,103

(22) Filed: Sep. 8, 2006

(65) Prior Publication Data

US 2007/0085290 A1 Apr. 19, 2007

Related U.S. Application Data

(60) Provisional application No. 60/726,712, filed on Oct. 14, 2005.

(51) Int. Cl.
*B62M 1/00* (2006.01)

(52) U.S. Cl. ..... 280/11.27; 280/87.042

(58) Field of Classification Search ..... 280/87.01, 280/87.021, 87.041, 87.042, 11.27, 11.28; D21/765

See application file for complete search history.

(56) References Cited

U.S. PATENT DOCUMENTS

| | | | | | |
|---|---|---|---|---|---|
| 4,183,546 | A * | 1/1980 | Heilig | ..... | 280/87.042 |
| 4,775,162 | A * | 10/1988 | Chao | ..... | 280/87.041 |
| 5,154,436 | A * | 10/1992 | Jez et al. | ..... | 280/87.042 |
| D478,643 | S * | 8/2003 | Langford et al. | ..... | D21/765 |
| 6,896,274 | B2 * | 5/2005 | Leslie | ..... | 280/87.042 |
| 6,938,907 | B2 * | 9/2005 | Hamy | ..... | 280/87.042 |

OTHER PUBLICATIONS www.gbomblongboards.com.
www.landyachtz.com.
"Creations of Keith in SLC" forum discussion on Nov. 5, 2004 on www.loadedboards.com.

* cited by examiner

*Primary Examiner*—Christopher P Ellis
*Assistant Examiner*—Brian Swenson
(74) *Attorney, Agent, or Firm*—Trent H. Baker; Baker & Associates PLLC

(57) ABSTRACT

The present invention relates to an improved skateboard system and method of assembly. One embodiment of the present invention relates to an improved skateboard system that includes coupling a mounting bracket between a conventional skateboard deck and truck. The mounting bracket effectively drops the deck closer to the ground, thereby enabling increased stability and performance. Likewise, the design and materials of the bracket provide increased vibrational dampening for the system. In addition, the couplings between the bracket and deck and the bracket and truck are releasable to enable interchanging of components. A second embodiment of the present invention relates to an individual skateboard bracket. The bracket further includes a truck coupling region, a medial region, and a deck coupling region. In profile, the truck coupling region is generally higher than the deck coupling region, facilitating an overall drop-down shape. The medial region is a sloped or curved region disposed below the truck coupling region and the deck coupling region. A third embodiment of the present invention relates to a method for assembling a skateboard, including releasably coupling a deck to a bracket and releasably coupling a truck to the bracket such that the releasable coupling between the deck and the bracket is lower than the releasable coupling between the truck and the bracket.

20 Claims, 3 Drawing Sheets

SKATEBOARD SYSTEM

RELATED APPLICATIONS

This application claims priority to U.S. provisional application Ser. No. 60/726,712 filed Oct. 14, 2005.

FIELD OF THE INVENTION

The invention generally relates to an improved skateboard system. In particular, the invention relates to an improved skateboard system and method of assembly.

BACKGROUND OF THE INVENTION

A skateboard is an athletic apparatus that allows a user to ride over a topographic surface. Conventional skateboards include a deck, a pair of trucks, and a set of four wheels. The deck provides an elongated flat or curved platform on which a user rides. The trucks are conventionally coupled to the bottom surface of either lengthwise side of the deck. Each truck is also coupled to a pair of wheels that extend below the remainder of the skateboard. The trucks translate vertical rotation of the deck into horizontal rotation of the wheels. This translation allows a user to lean or tilt the deck laterally and cause the skateboard to turn in the respective direction during forward movement. The wheels are generally made of urethane and have varying degrees of hardness/durometer depending on the application.

Skateboards have recently been designed to accommodate specific riding sub-disciplines, including longboarding, racing, and freestyle. Each of these sub-disciplines requires that a skateboard have certain performance characteristics so as to maximize a user's performance. For example, longboards generally include long decks and larger and softer wheels to facilitate carving. Likewise, freestyle boards generally include short decks and small hard wheels to enable users to perform various tricks. Racing boards are designed to allow users to ride at higher speeds and often include very rigid long decks and soft wheels.

Unfortunately, modern skateboard designs include many limitations and problems. Many users feel that skateboards can be very unstable especially at increased speeds. Responsiveness is the ability to have the skateboard act in a way intended by the user. It is desirable for a skateboard to intuitively respond to the movements of the user while maintaining stability so as to avoid unintended responses. In addition, many conventional skateboards fail to properly absorb vibrations in a manner that maintains performance. For example, using a flexible material for the deck allows the deck to sag and dramatically affects its responsiveness. Likewise, certain skateboard components are not easily interchangeable, forcing users to purchase multiple complete skateboards for particular performance applications or stylistic design features. Various improved skateboards have attempted to overcome these problems but have failed to integrate the solutions in a single skateboard.

Accordingly, there is a need in the industry for an improved skateboard system that overcomes these limitations in a cost effective and stylistically attractive manner.

SUMMARY OF THE INVENTION

The present invention relates to an improved skateboard system and method of assembly. One embodiment of the present invention relates to an improved skateboard system that includes coupling a mounting bracket between a conventional skateboard deck and truck. The mounting bracket effectively drops the deck closer to the ground, thereby enabling increased stability and performance. Likewise, the design and materials of the bracket provide increased vibrational dampening for the system. In addition, the couplings between the bracket and deck and the bracket and truck are releasable to enable interchanging of components. A second embodiment of the present invention relates to an individual skateboard bracket. The bracket further includes a truck coupling region, a medial region, and a deck coupling region. In profile, the truck coupling region is generally higher than the deck coupling region, facilitating an overall drop-down shape. The medial region is a sloped or curved region disposed below the truck coupling region and the deck coupling region. A third embodiment of the present invention relates to a method for assembling a skateboard, including releasably coupling a deck to a bracket and releasably coupling a truck to the bracket such that the releasable coupling between the deck and the bracket is lower than the releasable coupling between the truck and the bracket.

Systems and methods of the present invention provide numerous advantages over conventional skateboards. These advantages include increased system stability that more accurately translates a user's movements into the desired response. In addition, a level of dampening between the trucks and deck is achieved without dramatically compromising the performance of the system. The components of the system are also releasably coupled to one another, allowing for interchangeability. These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof, illustrated in the appended drawings. Understanding that these drawings depict only typical embodiments of the invention and are therefore not to be considered limiting of its scope, the invention will be described and explained with additional specificity and detail through the use of the accompanying drawings in which.

DETAILED DESCRIPTION OF THE INVENTION

Figure 1:
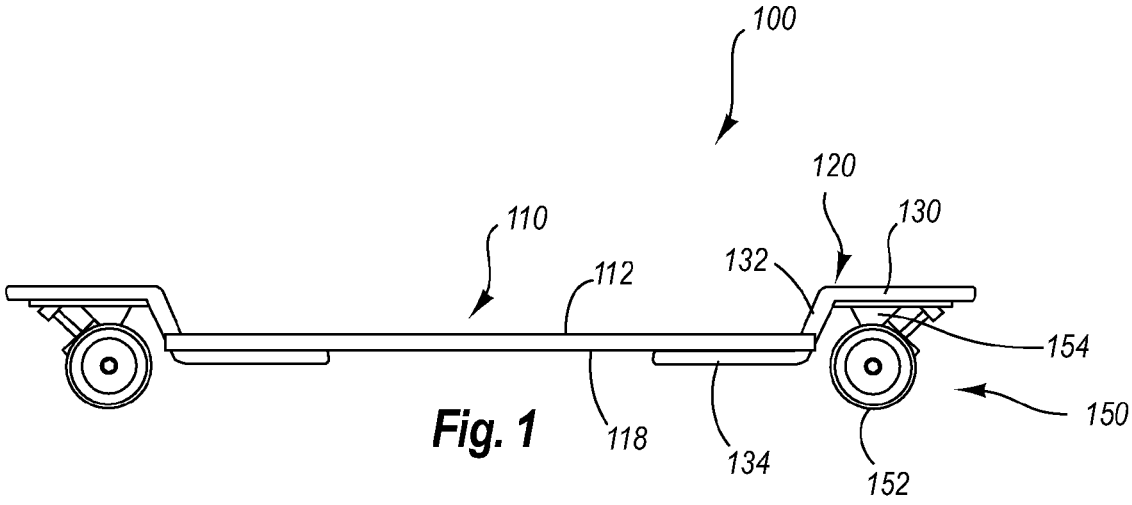
FIG. 1 illustrates a profile view of a skateboard system in accordance with one embodiment of the present invention.

The present invention may be embodied in other specific forms without departing from its spirit or essential characteristics. The described embodiments are to be considered in all respects as only illustrative and not restrictive. The scope of the invention is therefore indicated by the appended claims rather than by the foregoing description. All changes that come within the meaning and range of equivalency of the claims are to be embraced within their scope.

The present invention relates to an improved skateboard system and method of assembly. One embodiment of the present invention relates to an improved skateboard system that includes coupling a mounting bracket between a conventional skateboard deck and truck. The mounting bracket effectively drops the deck closer to the ground, thereby enabling increased stability and performance. Likewise, the design and materials of the bracket provide increased vibrational dampening for the system. In addition, the couplings between the bracket and deck and the bracket and truck are releasable to enable interchanging of components. A second embodiment of the present invention relates to an individual skateboard bracket. The bracket further includes a truck coupling region, a medial region, and a deck coupling region. In profile, the truck coupling region is generally higher than the deck coupling region, facilitating an overall drop-down shape. The medial region is a sloped or curved region disposed below the truck coupling region and the deck coupling region. A third embodiment of the present invention relates to a method for assembling a skateboard, including releasably coupling a deck to a bracket and releasably coupling a truck to the bracket such that the releasable coupling between the deck and the bracket is lower than the releasable coupling between the truck and the bracket. While embodiments of the present invention are directed at an improved skateboard system and method of assembly, it will be appreciated that the teachings of the present invention are applicable to other fields.

The following terms are defined:

Truck—a skateboard component that translates vertical rotation into horizontal rotation. A truck may include one or more wheels. For example, a skateboard truck may translate the vertical rotation of a deck into the horizontal rotation of a set of wheels.

Deck—a skateboard component that comprises the riding surface for a user. A deck is generally shaped in an elongated manner and may be flat, curved, or some combination therein. For example, a skateboard deck may include a top surface with some type of grip tape and a bottom surface with a particular design.

Bracket—a unique skateboard component that is releasably coupled between a deck and truck.

Multi-level bracket—a bracket that includes at least two translationally separated levels. For example, an upper region and a lower region may be separated by a sloped medial region that is coupled between the upper and lower region.

Skateboard—a combination of components that includes at least two wheels and a riding surface.

Linear surface—a two or three dimensional surface that is mathematically linear, including but not limited to a flat surface, an angled flat surface, etc.

Figure 2:
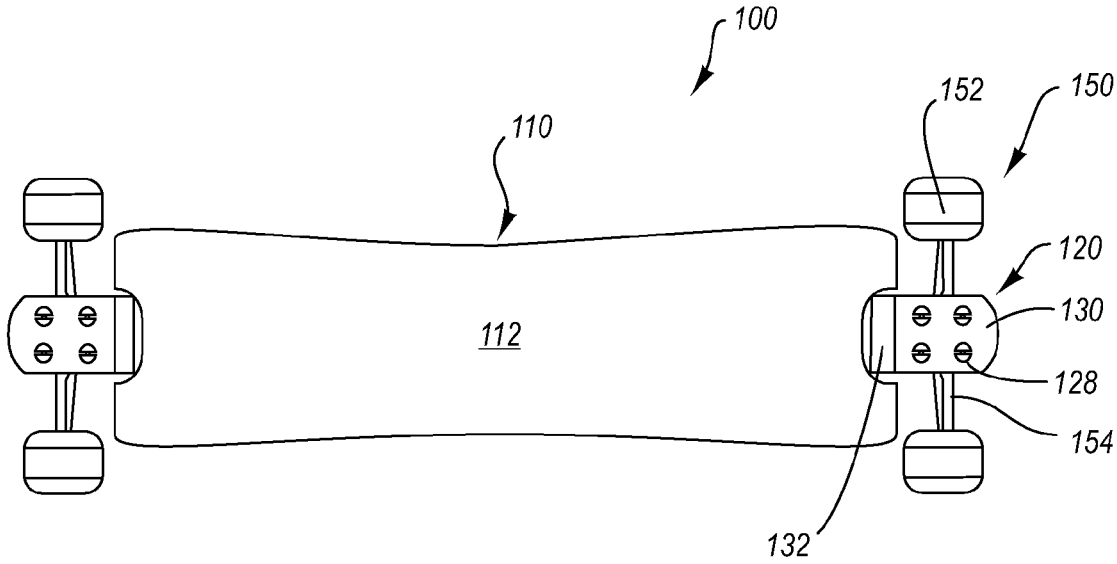
FIG. 2 illustrates a top view of the system illustrated in FIG. 1.

Reference is initially made to FIGS. 1 and 2, which illustrate a skateboard system in accordance with one embodiment of the present invention, designated generally at 100. The system 100 includes a deck 110, a pair of brackets 120, and a pair of trucks 150. The deck 110 is a platform that provides a user with a surface on which to engage the skateboard system 100. The deck 110 further includes a top riding surface, a bottom surface 118, and a plurality of releasable couplers (not shown). Although illustrated in a flat configuration, the deck 110 may be shaped in other manners such as concave, convex, curved, etc. and still remain consistent with the present invention. The deck may be composed of one or more materials to provide the desired flexibility and stiffness properties. Various well known lamination and/or shaping techniques may be used in the deck construction. The top riding surface 112 may include some form of grip tape to increase friction between a user's feet and the riding surface. Likewise, the bottom surface 118 may include some form of design or pattern. The plurality of releasable couplers releasably couple the deck 110 to the bracket 120 in the illustrated embodiment. It will be appreciated that any type of releasable coupling system may be used and remain consistent with the present invention, including but not limited to screws, bolts, adhesives, etc.

The trucks 150 are coupled to both lengthwise ends of the deck 110 via the bracket 120, as illustrated. The illustrated trucks 150 further include a support structure 154 and a pair of wheels 152. The support structure 154 includes various components including couplers 128, a baseplate, a hanger, two bushings, and a kingpin. Although illustrated with a conventional truck, skateboard systems in accordance with embodiments of the present invention may include various new or non-conventional trucks. The trucks 150 translate vertical rotational movements upon the baseplate into horizontal rotational movements across the hangers so as to turn the wheels when a rider laterally leans on the riding surface of the deck. The baseplate is releasably coupled to a bottom side of the bracket 120 via the couplers 128. Various well known releasable coupling systems may be used. The region of coupling between the bracket 120 and the trucks 150 is linear in the illustrated embodiment. It will also be noted that the coupling between the trucks 150 and the bracket 120 is higher than the coupling between the deck 110 and bracket 120.

Figure 3:
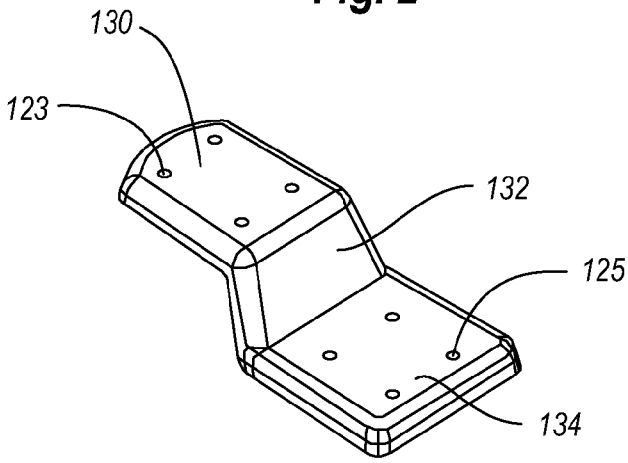
FIG. 3 illustrates a perspective view of the skateboard bracket illustrated in FIG. 1 in accordance with a second embodiment of the present invention.

In conjunction with FIGS. 1 and 2, reference is also made to FIG. 3, which illustrates a detailed perspective view of the bracket 120. Brackets 120 are disposed between the deck 110 and the trucks 150, as illustrated. Although the illustrated system 100 includes brackets on either end of the deck 110, a similar embodiment has been contemplated in which a bracket is disposed on only one side of the deck 110 while the opposite side of the deck is coupled directly to a truck. Conventional skateboards couple both trucks directly to the deck. The bracket 120 further includes an upper or truck coupling region 130, a lower or deck coupling region 134, and a medial region 132. The upper coupling region 130 is positioned higher than the lower coupling region 134. The upper and lower coupling regions 130, 134 are translationally separated from one another. The medial region 132 is disposed between the upper and lower coupling regions 130, 134 and is sloped, curved, and/or angled upward from the lower coupling region 130 to the upper coupling region 134. As illustrated in the alternative embodiments, various shapes and curvatures of the upper, lower, and medial regions 130, 134, 132 may be used in accordance with the present invention. It will also be appreciated that the various shapes, manufacturing processes, and composition materials will exhibit particular performance characteristics to selectively optimize desired skateboard systems 100. The upper coupling region 130 further includes a plurality of recesses or holes for releasable coupling to the trucks 150. Likewise, the lower coupling region 134 also includes a plurality of recesses or holes 125 for releasable coupling to the deck 110. The releasable couplings between the brackets 120 and deck 110 and the brackets 120 and trucks 150, allows for interchangeability of these components.

The detailed view of the bracket 120 illustrated in FIG. 3 includes flanged lower sides (not designated), which are disposed along the bottom of the upper, lower, and medial regions 130, 134, 132. The flanged lower sides encircle a substantially hollow region under the upper, lower, and medial regions 130, 134, 132. These flanged lower sides improve certain manufacturing processes and have the benefit of providing increased vibrational dampening between the trucks 150 and the deck 110. Various shapes and compositions may be used to affect performance, cost, weight, etc. For example, a combination of carbon-fiber composition and properly angled flanged lower sides may provide optimum dampening while minimizing overall bracket weight and maintaining bracket durability.

In operation, the system 100 provides a drop-down deck skateboard with improved performance characteristics over conventional skateboards. The system 100 is specifically configured such that the deck 110 is lower than the majority of the trucks 150. This is accomplished by coupling the deck 110 to the lower coupling region 134 of the bracket, and by coupling the trucks 150 to the upper coupling region 130, as illustrated. However, for sufficient translational separation of the trucks 150 from the deck 110, the bracket 120 is shaped to include the medial region 132. In addition, the trucks 150 are coupled to the bottom side of the bracket 120, while the deck 110 is coupled to the top side of the bracket 120. The relative positioning of the deck 110 with respect to the trucks 150 is known in the industry to affect overall performance and responsiveness to movements of a rider.

The multi-level, curved, or stepped shape characteristics of the bracket 120 also provide vibrational dampening between the deck 110 and the trucks 150. Vibrational dampening is an important performance characteristic in most sub-disciplines of skateboarding. For example, many conventional skateboard systems exhibit a loss of wheel traction during turns due to a lack of compliancy of the truck and wheels that are rigidly translated to the deck. By positioning the bracket 120 between the trucks 150 and deck 110, thus providing a degree of dampening, loss of traction is significantly reduced or eliminated. This damping also provides reductions in rider fatigue due to deck vibration. In addition, the drop-down positioning of the deck 110 in the illustrated system 100 enables users to more easily pedal the system 100 for movement across flat or inclined surfaces.

Figure 4:
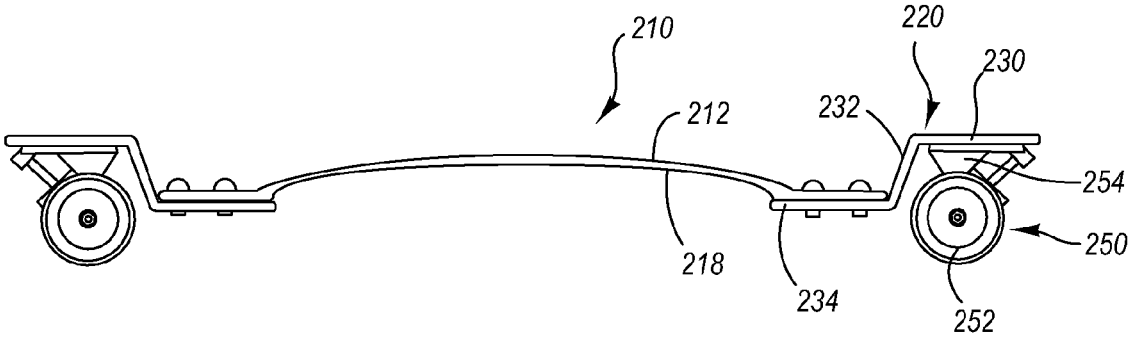
FIG. 4 illustrates a profile view of a skateboard system in accordance with an alternative embodiment of the present invention.
Figure 5:
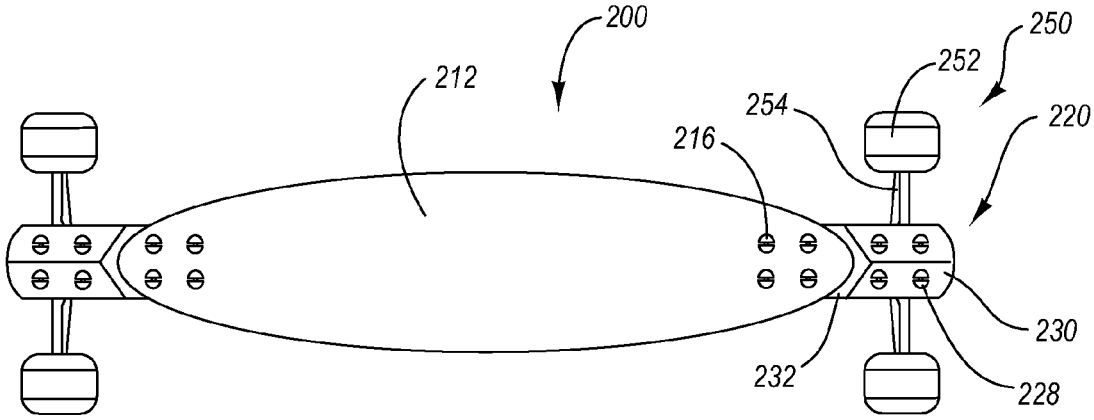
FIG. 5 illustrates a top view of the skateboard system illustrated in FIG. 4.
Figure 6:
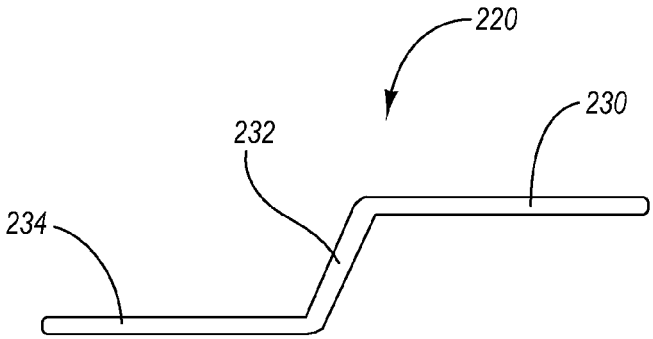
FIG. 6 illustrates the skateboard bracket shown in FIG. 4 in accordance with an alternative embodiment of the present invention.

Reference is next made to FIGS. 4-6, which illustrate a skateboard system and individual skateboard bracket in accordance with an alternative embodiment of the present invention, designated generally at 200 and 220, respectively. The system 200 includes a deck 210, a pair of trucks 250, and a pair of brackets 220. The illustrated alternative embodiment demonstrates that various shaped decks 110 and brackets 120 may be utilized and remain consistent with the present invention. The particular bracket design illustrated in FIG. 6 may be composed of a single piece of bent metal such as aluminum. The deck 210 includes a top and bottom surface 212, 218. Each bracket 220 includes an upper, lower, and medial coupling region 230, 234, 232. The upper coupling region 230 further includes a plurality of couplers 228 that releasably couple the trucks 250 to the bracket 220. The trucks 250 include a pair of wheels 252 and a support structure 254.

Figure 7:
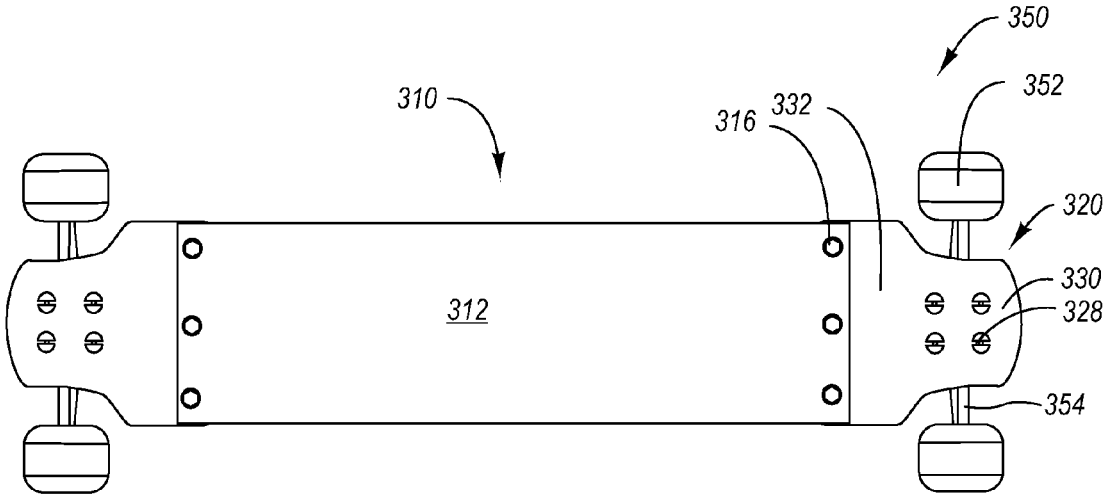
FIG. 7 illustrates a top view of a skateboard system in accordance with an alternative embodiment of the present invention.
Figure 8:
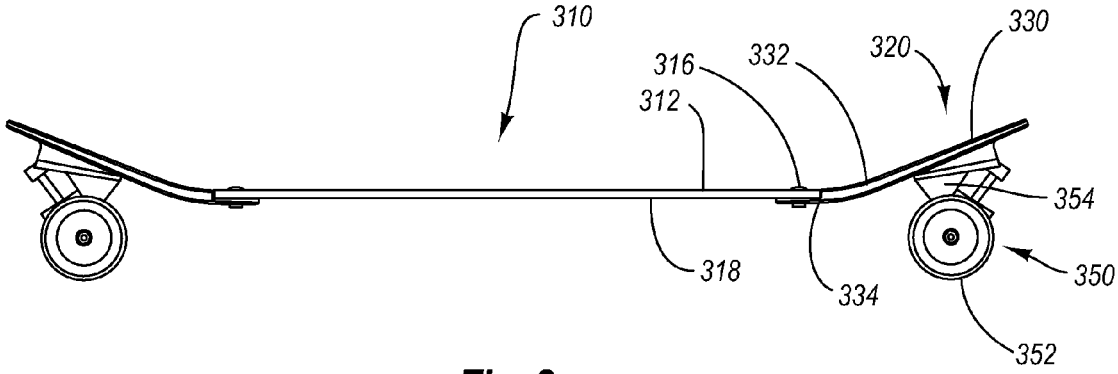
FIG. 8 illustrates a profile view of the skateboard system illustrated in FIG. 7.
Figure 9:
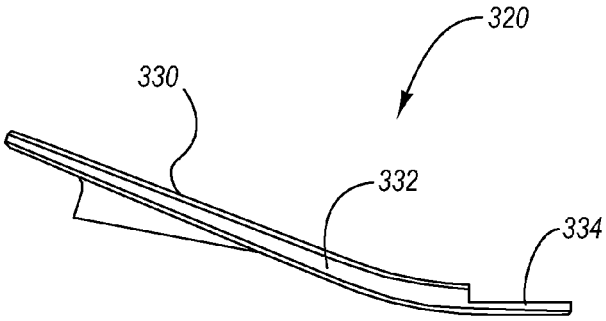
FIG. 9 illustrates a profile view of the skateboard bracket illustrated in FIG. 7 in accordance with an alternative embodiment of the present invention.

Reference is next made to FIGS. 7-9, which illustrate a skateboard system and individual skateboard bracket in accordance with an alternative embodiment of the present invention, designated generally at 300 and 320 respectively. The system 300 includes a deck 310, a pair of trucks 350, and a pair of brackets 320. The illustrated alternative embodiment further demonstrates that various shaped decks 310 and brackets 320 may be utilized and yet remain consistent with the present invention. The particular bracket design illustrated in FIG. 9 is uniquely shaped. The deck 310 includes a top and bottom surface 312, 318. The brackets 320 include an upper, lower, and medial coupling region 330, 334, 332. The upper coupling region 330 further includes a plurality of couplers 328 that releasably couple the bracket 320 to the trucks 350. Likewise, the lower coupling region 334 further includes a plurality of couplers 316 that releasably couple the brackets 320 to the deck 310. The trucks 350 include a pair of wheels 352 and a support structure 354.

Figure 10:
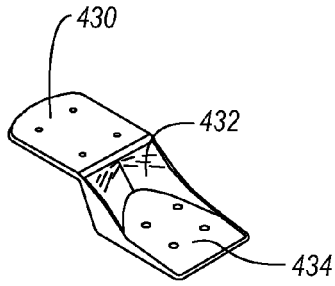
FIG. 10 illustrates a perspective view of a skateboard bracket in accordance with an alternative embodiment of the present invention.

Reference is next made to FIG. 10, which illustrates a perspective view of an individual skateboard bracket in accordance with an alternative embodiment of the present invention. The illustrated bracket includes an upper coupling region 430, a medial region 432, and a lower coupling region 434.

Thus, as discussed herein, the embodiments of the present invention relate to an improved skateboard system and method of assembly. The present invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes that come within the meaning and range of equivalency of the claims are to be embraced within their scope.

What is claimed is:

1. A skateboard system comprising:

at least one truck comprising two wheels, a support structure, and a truck-bracket coupling surface;

at least one deck comprising a riding surface and a deck-bracket coupling surface; and at least one multi-level bracket including a lower coupling region, a medial region, and an upper coupling region, wherein the medial region is disposed translationally between the lower coupling region and the upper coupling region, and wherein the truck-bracket coupling surface is releasably coupled to the upper coupling region and the deck-bracket coupling surface is releasably coupled to the lower coupling region.

2. The system of claim 1, wherein the releasable coupling between the upper coupling region and the truck-bracket coupling region is via a linear surface.

3. The system of claim 1, wherein, in profile, the upper coupling region is higher than the lower coupling region.

4. The system of claim 1, wherein the at least one deck includes an elongated shaped deck with two deck-bracket coupling surfaces disposed on either lengthwise side.

5. The system of claim 1, wherein the releasable coupling between the upper coupling surface and the truck-bracket coupling surface occurs on a bottom side of the multi-level bracket.

6. The system of claim 1, wherein the releasable coupling between the lower coupling surface and the deck-bracket coupling surface occurs on a top side of the multi-level bracket.

7. The system of claim 1, wherein the medial region slopes upward from the lower coupling region to the upper coupling region.

8. The system of claim 1, wherein the deck-bracket coupling surface is disposed on a bottom side of the deck and the riding surface is disposed on a top surface of the deck.

9. The system of claim 1, wherein the translational disposition of the medial region between the lower coupling region and the upper coupling region includes coupling the medial region to a side portion of the lower coupling region and a side portion of the upper coupling region.

10. The system of claim 1, wherein in profile, the deck overlaps the medial region of the multi-level bracket.

11. A skateboard mounting bracket configured to be releasably coupled to a deck and a truck so as to provide skateboard functionality, comprising:

a truck coupling region, wherein the truck coupling region includes a truck coupling surface on a bottom side of the truck coupling region;

a deck coupling region coupled to the truck coupling surface, wherein the deck coupling region includes a deck coupling surface, and wherein the deck coupling surface is disposed below the truck coupling surface;

a medial sloped region disposed between the truck coupling region and the deck coupling region.

12. The system of claim 11, wherein the truck coupling surface is linear.

13. The system of claim 11, wherein the truck coupling region is parallel to the deck coupling region.

14. The system of claim 11, wherein the medial sloped region is translationally disposed between the truck coupling region and the deck coupling region.

15. The system of claim 11, wherein the deck coupling surface is disposed on a top side of the deck coupling region.

16. A method for assembling a skateboard, comprising the acts of:

releasably coupling a deck to a deck coupling surface on a multi-level bracket; and releasably coupling a truck to a truck coupling surface on the multi-level bracket, wherein the truck coupling surface is above the deck coupling surface, and wherein the truck coupling surface is translationally separated from the deck coupling surface.

17. The method of claim 16, wherein the truck coupling surface is linear.

18. The method of claim 17, wherein the method further includes releasably coupling a second multi-level bracket to the deck and releasably coupling a second truck to the second multi-level bracket.

19. The method of claim 16, wherein the act of releasably coupling a truck to a truck coupling surface on the multi-level bracket includes releasably coupling the truck below the multi-level bracket.

20. The method of claim 16, wherein the act of releasably coupling a deck to a deck coupling surface on a multi-level bracket includes aligning a medial region of a lengthwise end of the deck over the deck coupling surface.

* * * * *